US011209179B2

(12) United States Patent
Kim

(10) Patent No.: US 11,209,179 B2
(45) Date of Patent: Dec. 28, 2021

(54) VENTILATOR

(71) Applicant: Tae Joong Kim, Anyang-si (KR)

(72) Inventor: Tae Joong Kim, Anyang-si (KR)

( * ) Notice: Subject to any disclaimer, the term of this patent is extended or adjusted under 35 U.S.C. 154(b) by 47 days.

(21) Appl. No.: 15/740,800

(22) PCT Filed: Jun. 20, 2017

(86) PCT No.: PCT/KR2017/006475
§ 371 (c)(1),
(2) Date: Dec. 29, 2017

(87) PCT Pub. No.: WO2018/004178
PCT Pub. Date: Jan. 4, 2018

(65) Prior Publication Data

US 2020/0149759 A1 May 14, 2020

(30) Foreign Application Priority Data

Jul. 1, 2016 (KR) ..... 10-2016-0083626

(51) Int. Cl.
*F24F 7/06* (2006.01)
*F04D 19/00* (2006.01)
(Continued)

(52) U.S. Cl.
CPC ..... *F24F 7/06* (2013.01); *F04D 19/002* (2013.01); *F04D 29/403* (2013.01);
(Continued)

(58) Field of Classification Search
CPC ..... F24F 1/0007; F24F 1/0047; F24F 1/0014; F24F 1/0022; F24F 13/08; F24F 13/081;
(Continued)

(56) References Cited

U.S. PATENT DOCUMENTS 7,908,879 B1 * 3/2011 Chen ..... F24F 1/0047 62/259.1
8,070,420 B2 * 12/2011 Chen ..... F24F 7/025 415/98

FOREIGN PATENT DOCUMENTS

CN 104566587 A 4/2015
CN 109611998 A 4/2019
(Continued)

OTHER PUBLICATIONS

Machine Translation of KR 20120034333A [retrieved on Feb. 19, 2021]. Retrieved from: Espacenet. (Year: 2021).*
(Continued)

*Primary Examiner* — J. Todd Newton
*Assistant Examiner* — Eric J Zamora Alvarez
(74) *Attorney, Agent, or Firm* — Antonio Ha & U.S. Patent, LLC

(57) ABSTRACT

The present invention relates to a ventilator, aiming easier cleanup even in the position mounted on the ceiling or wall. According to the present invention, a ventilator may comprise an outer casing having a mounting space in an inside thereof, an inner casing mounted in the mounting space of the outer casing, a blowing fan received in an inner space of the inner casing, and a motor rotating the blowing fan, wherein a wave-shaped flow path is formed on each inner wall surface of the inner casing.

3 Claims, 6 Drawing Sheets

(51) Int. Cl.

| | |
|---|---|
| ***F04D 29/40*** | (2006.01) |
| ***F04D 29/52*** | (2006.01) |
| ***F04D 29/54*** | (2006.01) |
| ***F04D 29/70*** | (2006.01) |
| ***F24F 13/20*** | (2006.01) |
| ***F04D 25/08*** | (2006.01) |

(52) U.S. Cl.
CPC ..... *F04D 29/522* (2013.01); *F04D 29/545* (2013.01); *F04D 29/705* (2013.01); *F24F 13/20* (2013.01); *F05B 2240/14* (2013.01); *F24F 2013/205* (2013.01); *F24F 2221/225* (2013.01)

(58) Field of Classification Search
CPC ..... F24F 2221/14; F24F 7/06; F24F 13/20; F24F 2013/205; F24F 2221/225; F04D 19/002; F04D 25/088; F04D 29/4226; F04D 29/626; F04D 29/646; F04D 29/403; F04D 29/522; F04D 29/545; F04D 29/70; F04D 29/705; F05B 2240/14
See application file for complete search history.

(56) References Cited

FOREIGN PATENT DOCUMENTS

| | | |
|---|---|---|
| JP | S53-129437 | 11/1978 |
| JP | H8-257336 | 10/1996 |
| JP | 08-320141 | 12/1996 |
| JP | 5396909 | 1/2014 |
| KR | 10-0145405 | 4/1998 |
| KR | 10-2012-0034333 | 4/2012 |
| KR | 10-1237310 | 2/2013 |
| KR | 10-2013-0021937 | 3/2013 |
| KR | 10-1370115 | 3/2014 |
| KR | 10-1450606 | 10/2014 |
| KR | 10-2015-0042511 | 4/2015 |

OTHER PUBLICATIONS

English Abstract of 08-320141.
English Specification of 10-2013-0021937.
English Abstract of 5396909.
English Specification of 10-2012-003433.
English Specification of 10-1450606.
English Specification of 10-2015-0042511.
English Specification of CN104566587A.
English Specification of CN109611998A.
English Specification of 10-1237310.
English Specification of H8-257336.
English Specification of S53-129437.
English Specification of 10-0145405.
English Specification of 10-1370115.

* cited by examiner

VENTILATOR

TECHNICAL FIELD

The present invention relates to a ventilator.

DISCUSSION OF RELATED ART

Generally, ventilators are installed in the ceiling or wall to exhaust contaminated air from the room to the outside.

Continuous use of the ventilator leads to the accumulation of dust or other foreign bodies in the casing or blowing fan, and thus, the casing and blowing fan require periodic cleanup.

Ventilators, which are typically ceiling- or wall-mounted, require that they be removed from the ceiling or wall for cleanup, and after done, mounted back, resulting in tricky maintenance.

Korean Patent Application Publication No. 10-2015-0042511 is relevant to the present invention.

SUMMARY

The present invention has been conceived to address the problems with the prior art and aims to provide a ventilator capable of easier cleanup even when installed or mounted in the ceiling or wall.

According to a first embodiment of the present invention, a ventilator comprises an outer casing having a mounting space in an inside thereof, an inner casing mounted in the mounting space of the outer casing, a blowing fan received in an inner space of the inner casing, and a motor rotating the blowing fan, wherein a wave-shaped flow path is formed on each inner wall surface of the inner casing.

An auxiliary flow path shaped as a screw is formed on a ceiling of the inner casing.

The ventilator further comprises a washing unit, the washing unit including a supplying unit inserted or removed between the outer casing and the inner casing and having a washing product supplying space in an inside thereof, the washing product supplying space connected with the inner space of the inner casing, and an injection tube provided in the supplying unit to inject a washing product to the inner space of the inner casing through the washing product supplying space and having a drain in a side thereof.

A packing and another packing, respectively, are formed on an inner wall surface of the outer casing and an outer wall surface of the inner casing to face each other.

According to a second embodiment of the present invention, a ventilator comprises an outer casing having a first ventilation hole for ventilation in a side and a mounting space in an inside thereof, an inner casing mounted in the mounting space of the outer casing and having a second ventilation hole in a side thereof, the second ventilation hole connected with the first ventilation hole, a blowing fan received in an inner space of the inner casing, a motor rotating the blowing fan, and a jet tube provided on an inner wall surface of the inner casing, having multiple jet holes for jetting a washing product provided at intervals, and having a side portion protruding to an outside of the inner casing.

According to the present invention, the ventilator is capable of easier cleanup of the inside, even while being embedded or installed in the ceiling or wall of the building. Thus, the ventilator may stay clean, and so may the air in the building.

DETAILED DESCRIPTION OF EXEMPLARY EMBODIMENTS

Hereinafter, the present invention is described in detail with reference to the drawings.

First Embodiment

Figure 1:
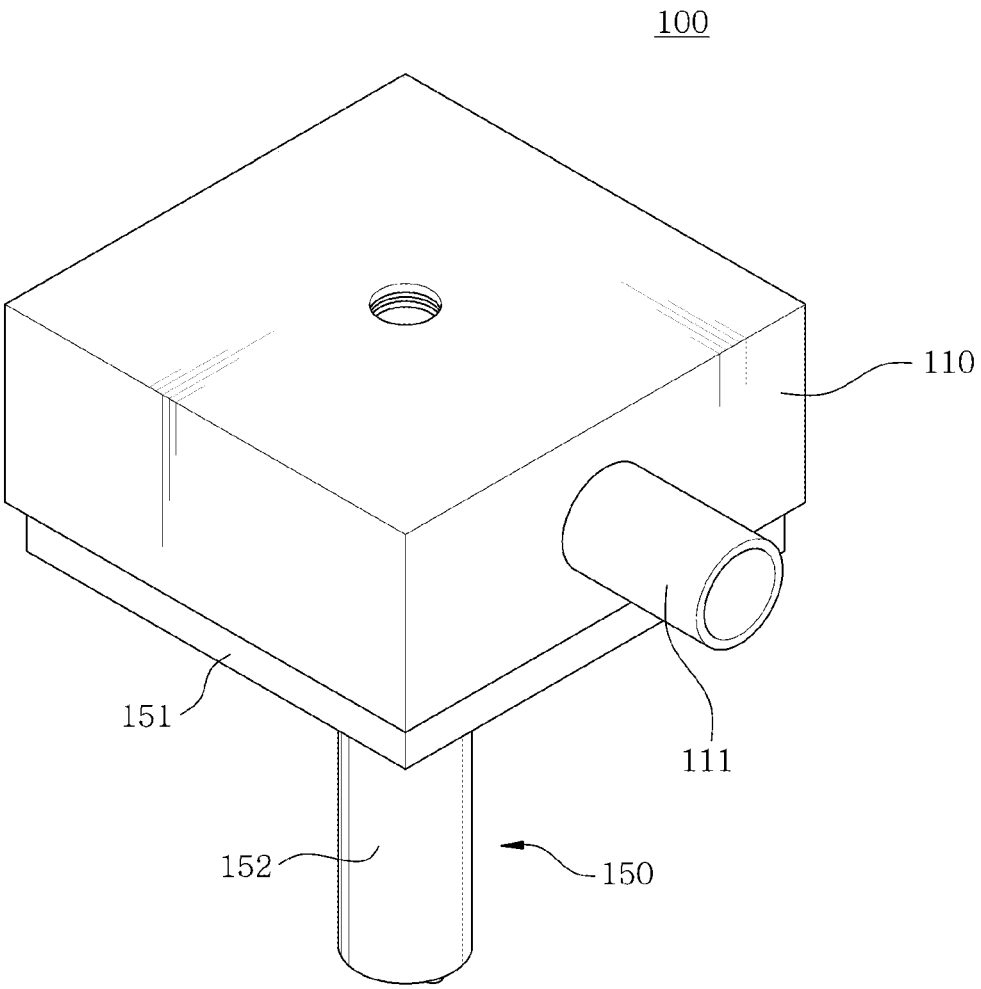
FIG. 1 is a perspective view illustrating a ventilator according to a first embodiment of the present invention.
Figure 2:
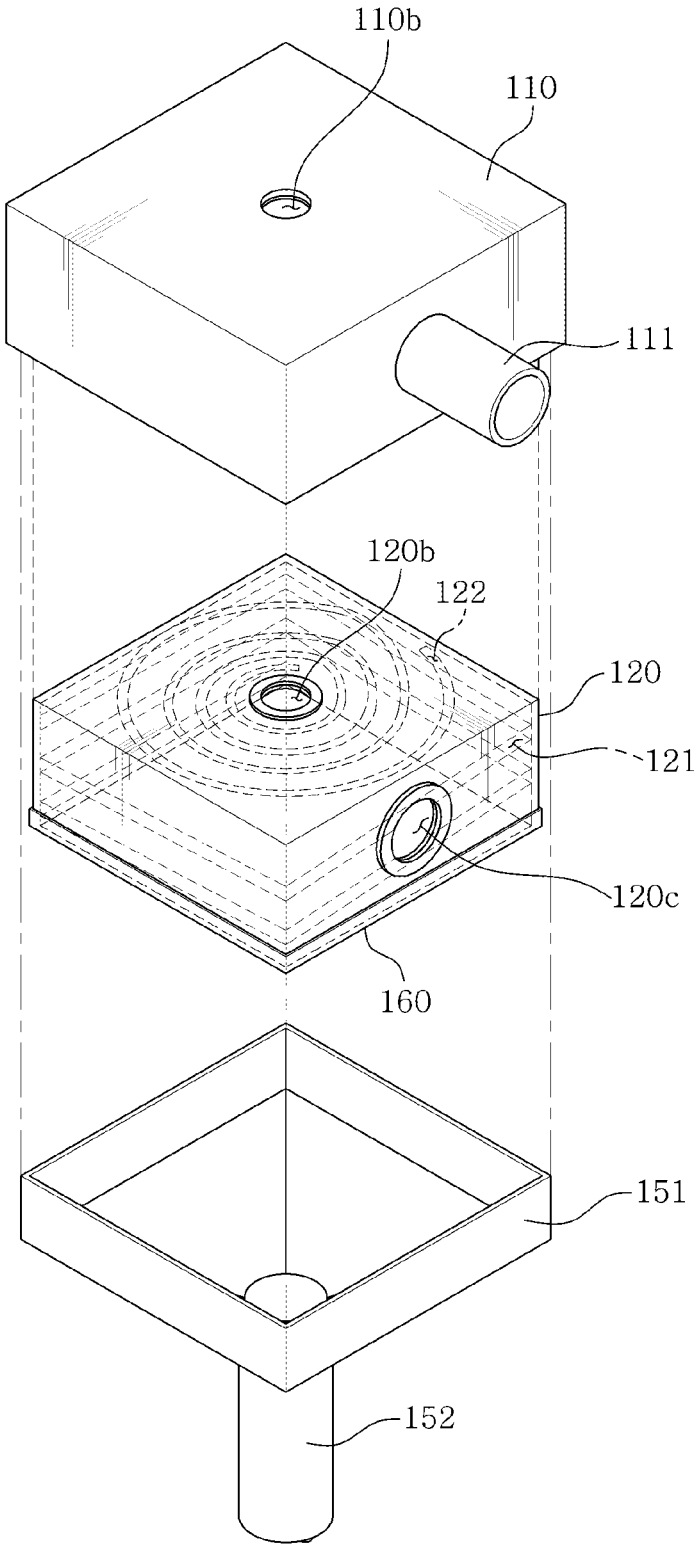
FIG. 2 is an exploded perspective view illustrating the ventilator according to the first embodiment of the present invention.
Figure 3:
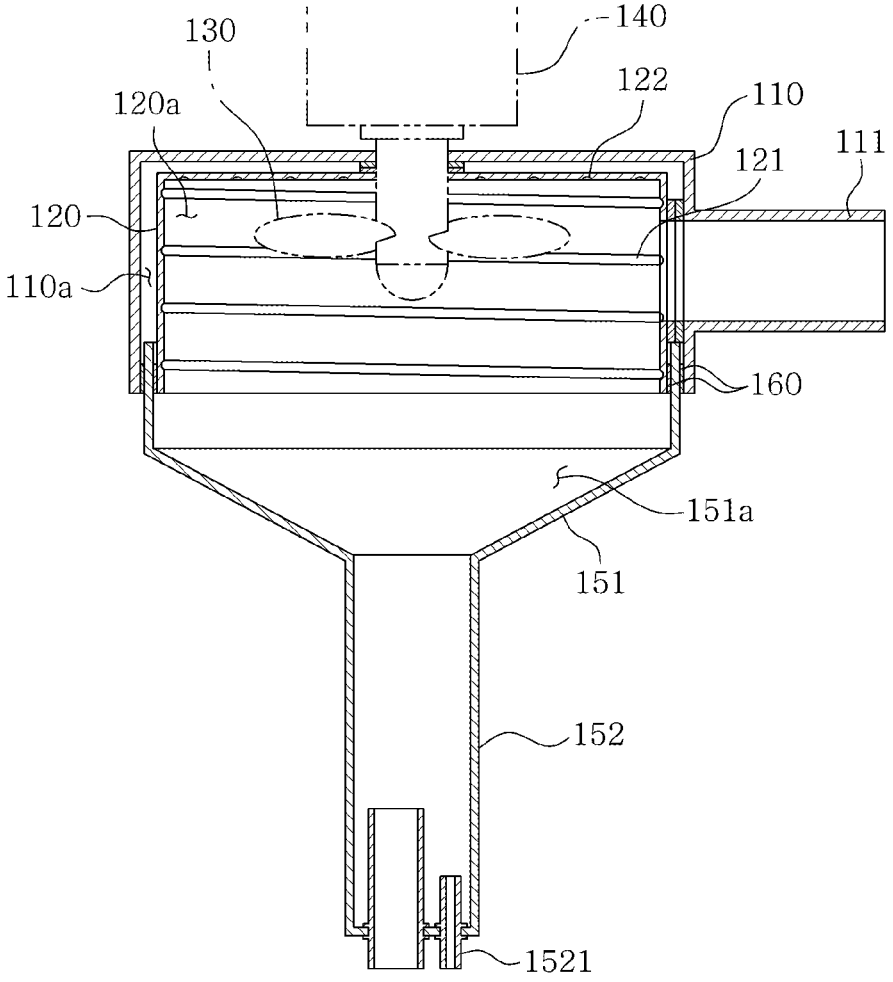
FIG. 3 is a cross-sectional view illustrating an example of use of the ventilator according to the first embodiment of the present invention.

FIG. 1 is a perspective view illustrating a ventilator according to a first embodiment of the present invention. FIG. 2 is an exploded perspective view illustrating the ventilator according to the first embodiment of the present invention. FIG. 3 is a cross-sectional view illustrating an example of use of the ventilator according to the first embodiment of the present invention.

The ventilator 100 according to the first embodiment of the present invention is intended for easier cleanup of the inside even when embedded in the ceiling of a building and includes an outer casing 110, an inner casing 120, a blowing fan 130, and a motor 140.

The outer casing 110 is embedded in the ceiling. The outer casing 110 may be formed in various shapes, e.g., a rectangular or cylindrical block, with a predetermined volume. The figures show an example in which the outer casing 110 is shaped as a box.

The outer casing 110 has an opening in the bottom and has a space 110*a* inside to have the inner casing 120 mounted.

The outer casing 110 is embedded in the ceiling, with the opening facing the floor or ground. The outer casing 110 has an installation hole 110*b* formed at the center in the top for installation of a motor 140.

A grill-shaped blocking film 170 is installed in the opening of the outer casing 110 to minimizing the exposure of the blowing fan 130 while protecting the user's safety.

An exhaust pipe 111 is installed in a side wall of the outer casing 110 to exhaust air from the room through the blowing fan 130 to the outside.

The inner casing 120 is shaped as a rectangular block with a predetermined volume. The inner casing 120 has an opening in the bottom. The inner casing 120 has an inner space 120*a* for receiving the blowing fan 130.

The inner casing 120 is mounted in the mounting space 110*a* of the outer casing 110, with the opening facing the floor. An installation hole 120*b* is formed at the center in the top to be aligned with the installation hole 110*b* along the vertical line.

The top surface of the inner casing 120 may be bolted to the ceiling of the outer casing 110.

The inner casing 120 may be sized to be smaller than the mounting space 110*a* of the outer casing 110, thus leaving an empty space between the outer wall surface of the inner casing 120 and the inner wall surface of the outer casing 110 for insertion of a supplying unit 151 which is described below.

An exhaust hole 120*c* is formed in a side wall of the inner casing 120 to be aligned with the exhaust pipe 111 of the outer casing 110 along the horizontal line.

In other words, air sucked in the room through the blowing fan 130 may be exhausted sequentially via the exhaust hole 120*c* and the exhaust pipe 111.

A flow path 121 which has a wave shape is formed on the inner wall surfaces along a vertical lengthwise direction.

The flow path 121 may have a groove shape and may be formed by pressing the inner wall surfaces of the inner casing 120 with a press machine.

A coiled auxiliary water flow 122 is formed in the ceiling of the inner casing 120. The auxiliary flow path 122 is shaped as a groove and may be formed by pressing the ceiling of the inner casing 120 with a press machine.

The flow path 121 and the auxiliary flow path 122 may be intended for evenly distributing the washing product which is described below, and their operation is described below in detail.

A packing 160 is attached by, e.g., an adhesive, to each inner wall surface in a lower portion of the outer casing 110, and another packing 180 is attached by an adhesive to each outer wall surface in a lower portion of the inner casing 120.

In their regular position, the packings 160 and 180 may face each other and remain in contact with each other, preventing dust from being introduced between the outer casing 110 and the inner casing 120.

After the packings 160 and 180 are opened, a washing unit 150 may be inserted between the outer casing 110 and the inner casing 120 to clean the inside of the inner casing 120 and the blowing fan 130.

The washing unit 150 includes a supplying unit 151 and an injection tube 152. The supplying unit 151 has an opening in the top and a washing product supplying space 151*a* in the inside. The supplying unit 151 is shaped as a rectangular box.

The shape of the supplying unit 151 may be varied depending on the shape of the outer casing 110 and the inner casing 120.

The bottom of the supplying unit 151 is shaped to be tapered towards the center.

An upper portion of the supplying unit 151 may be inserted or removed between the outer casing 110 and the inner casing 120, and when inserted, the upper portion of the supplying unit 151 may remain fixed between the packings 160 and 180.

The injection tube 152 may be shaped as a circular bar or rectangular bar having a predetermined length and circumference, and its upper portion may pass through a middle portion of the bottom of the supplying unit 151. A tube-shaped drain 1521 is formed in the bottom of the injection tube 152.

The blowing fan 130 is received in the inner space 120*a* of the inner casing 120, receives power from the motor 140, which is described below, to rotate in place, sucking and exhausting air from the room through the exhaust pipe 111 to the outside.

The motor 140 is provided to pass through the installation holes 110*b* and 120*b*, and the shaft of the motor 140 is mounted in a center portion of the blowing fan 130.

The motor 140 may be a DC motor or AC motor the shaft of which rotates in a forward or backward direction.

In other words, when the motor 140 is powered to rotate the blowing fan 130 in place, an air pressure difference is caused, allowing air in the room to be sucked.

Here, the motor 140 is preferably waterproofed not to contact washing product which is described below.

Now described are operations of the ventilator according to the first embodiment of the present invention and unique effects that may be obtained when the ventilator operates.

First, the inner casing 120 is mounted in the mounting space 110*a* of the outer casing 110, and the blowing fan 130 is positioned in the empty space of the inner casing 120. Then, the blowing fan 130 is mounted on the shaft of the motor 140, and the ventilator is embedded in the ceiling of the building.

Typical methods for embedding a ventilator may be used to embed the ventilator according to the present invention, and thus, no detailed description thereof is given.

Meanwhile, continuous use of the ventilator 100 causes dust or foreign bodies to build up in the inner space 120*a* of the inner casing 120 and on the blowing fan 130 in which case a washing product, e.g., water, may easily be supplied to the inner space 120*a* of the inner casing 120 and the blowing fan 130 through the washing unit 150 even without removing the ventilator 100 from the ceiling, leading to easier cleanup of the ventilator 100.

Specifically, the blocking film 170 is removed from the outer casing 110, and the upper portion of the supplying unit 151 is then inserted between the outer casing 110 and the inner casing 120.

The upper portion of the supplying unit 151 is fixed between the packings 160 and 180, and the fixed portion may remain airtightly sealed, preventing leakage of the washing product supplied to the inner space 120*a* of the inner casing 120.

Then, a washing water supplying device is connected to the injection tube 152.

The washing water supplying device may include a storage tank for storing washing water and a pump connected with the storage tank and the injection tube 152.

In other words, as the pump operates, the washing water stored in the storage tank is sprayed or jetted through the injection tube 152 and the washing product supplying space 151*a* to the mounting space 110*a* of the inner casing 120 and the blowing fan 130, removing foreign bodies from the inner space 110*a* and the blowing fan 130.

Further, a portion of the washing water sprayed or jetted flows along the flow path 121 and the auxiliary flow path 122, allowing the washing water to evenly pass along the inner wall surfaces and ceiling of the inner casing 120 to remove foreign bodies. The washing water may be swirled and quickly moved by the flow path 121 and the auxiliary flow path 122, shortening the time of cleanup of the blowing fan 130 and the mounting space 110*a* of the inner casing 120.

Further, the flow path 121 and the auxiliary flow path 122 may function as reinforcing ribs, adding rigidity and durability to the inner casing 120.

The washing water jet to the blowing fan 130 and the mounting space 110*a* of the inner casing 120 may be dropped by its own weight, and the bottom of the supplying unit 151 is tapered towards the center. Thus, the washing water may easily be discharged through the drain 1521 to the outside.

Meanwhile, an air supplying device, e.g., an air compressor, instead of the washing water supplying device, may be connected to the injection tube 152, so that the blowing fan 130 and the mounting space 110*a* of the inner casing 120 can be cleaned by air flows.

As set forth above, the ventilator 100 according to the first embodiment of the present invention enables frequent cleaning of the blowing fan 130 and the inside of the inner casing 120 by its configuration and unique features, leaving itself and air in the building clean all the time.

Second Embodiment

Figure 4:
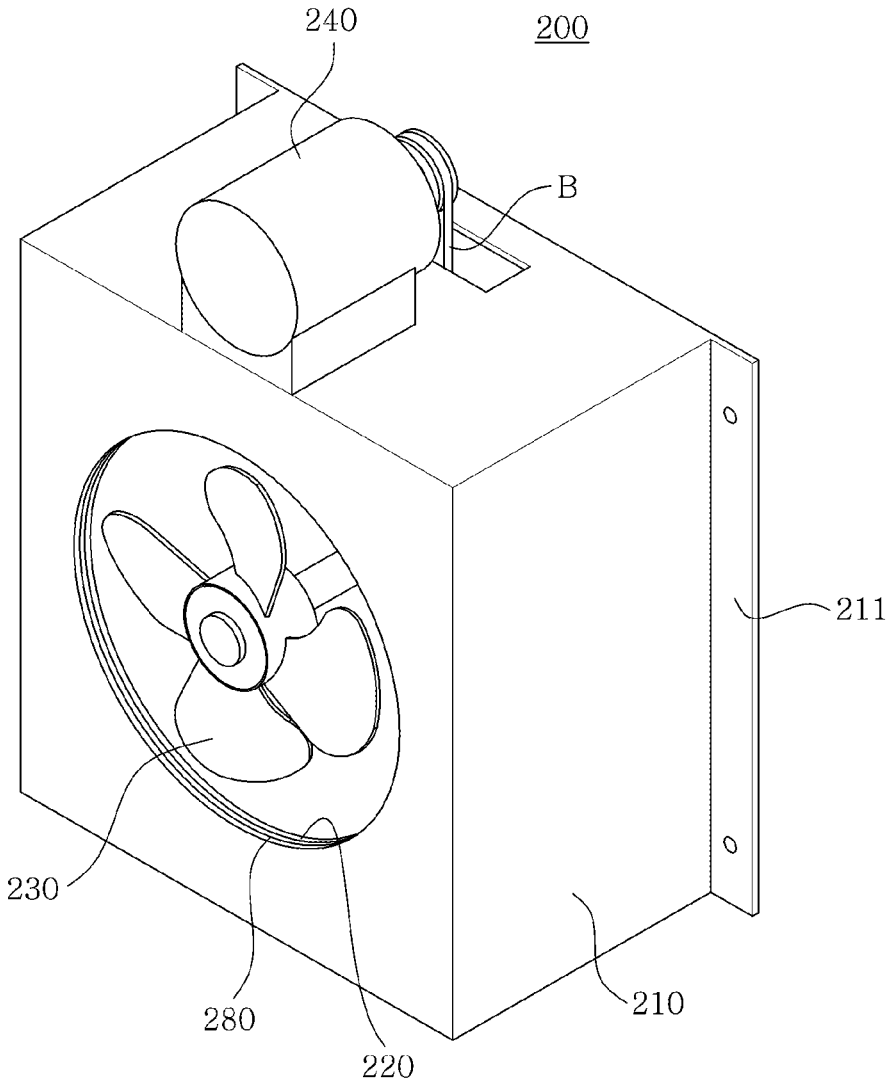
FIG. 4 is a perspective view illustrating a ventilator assembled, according to a second embodiment of the present invention.
Figure 5:
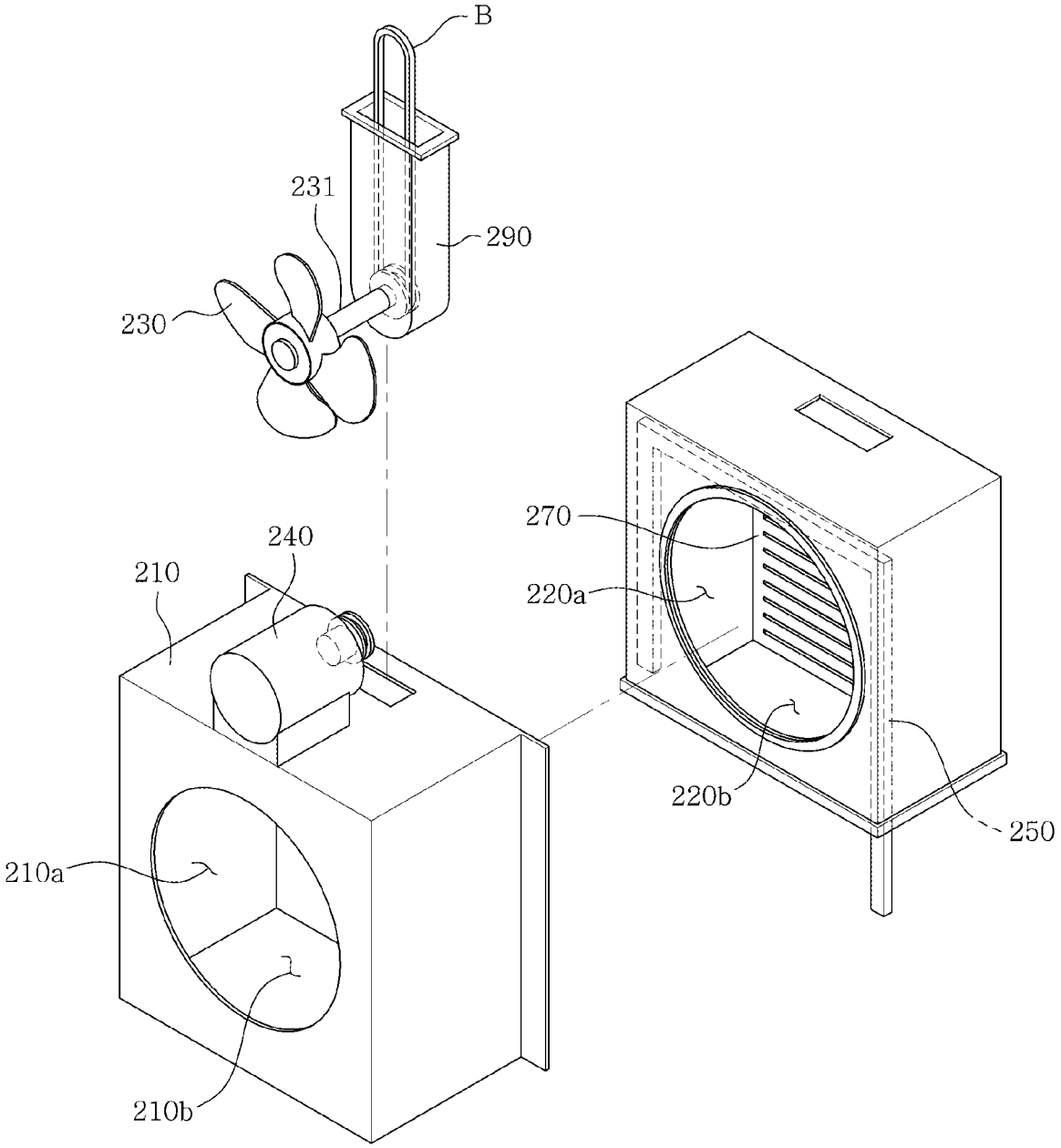
FIG. 5 is an exploded perspective view illustrating the ventilator according to the second embodiment of the present invention.
Figure 6:
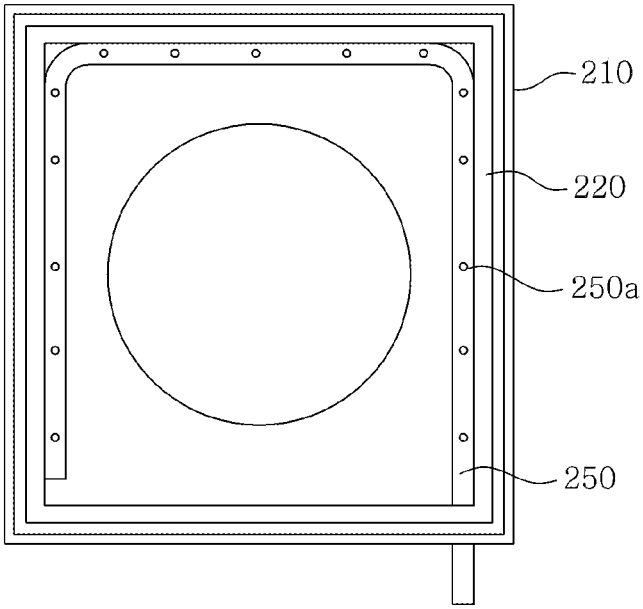
FIG. 6 is a view illustrating a state in which a jet pipe is installed inside an inner casing applied to the ventilator according to the second embodiment of the present invention.
Figure 7:
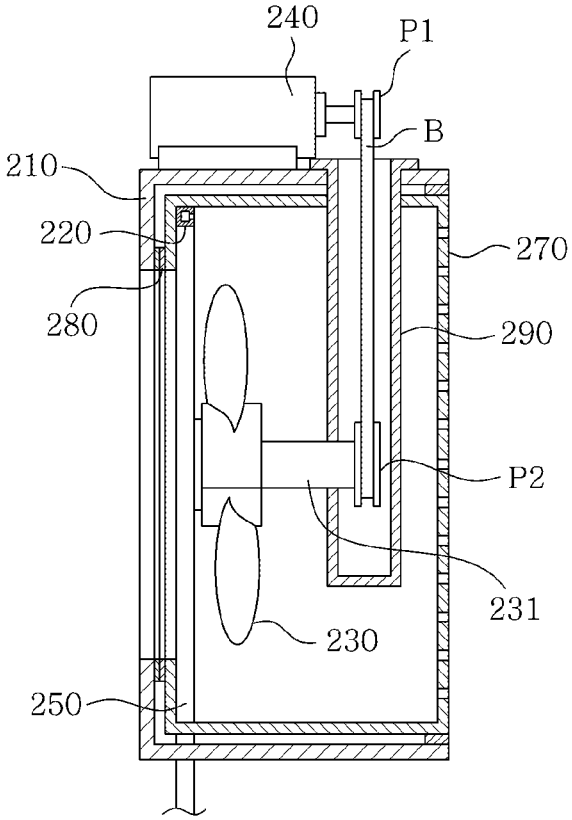
FIG. 7 is a cross-sectional view illustrating the ventilator according to the second embodiment of the present invention.

FIG. 4 is a perspective view illustrating a ventilator assembled, according to a second embodiment of the present invention. FIG. 5 is an exploded perspective view illustrating the ventilator according to the second embodiment of the present invention. FIG. 6 is a view illustrating a state in which a jet pipe is installed inside an inner casing applied to the ventilator according to the second embodiment of the present invention. FIG. 7 is a cross-sectional view illustrating the ventilator according to the second embodiment of the present invention.

The ventilator 200 according to the second embodiment of the present invention is intended for easier cleanup of the inside even when installed in the inner wall of building. The ventilator 200 includes an outer casing 210, an inner casing 220, a blowing fan 230, a motor 240, and a jet tube 250.

The outer casing 210 is installed in the inner wall of building. The outer casing 210 may be shaped as a rectangular or cylindrical box with a predetermined volume. The figures show an example in which the outer casing 210 is shaped as a rectangular box.

The outer casing 210 has an opening in the bottom and a mounting space 210*b* inside to have the inner casing 220 mounted.

The outer casing 210 has a first ventilation hole 210*a* in the front for ventilation. The first ventilation hole has a predetermined diameter. Flanges 211 are formed on both sides of the rear surface to be fixed to the wall in the room via, e.g., a fastening means, e.g., bolts.

A blocking film 260 is provided in the first ventilation hole 210*a* of the outer casing 210 to protect the user's safety.

The inner casing 220 is mounted in the mounting space 210*b* of the outer casing 210, shaped as a rectangular box with a predetermined volume, and has an inner space 220*a* for receiving the blowing fan 230 and the motor 240.

In this case, the top of the inner casing 220 may be bolted to the ceiling of the outer casing 210, or the top of the inner casing 220 may be attached to the ceiling of the outer casing via an adhesive.

The inner casing 220 has a second ventilation hole 200*b* in the front for ventilation. The second ventilation hole 200*b* has a predetermined diameter. The second ventilation hole 200*b* and the first ventilation hole 210*a* are connected together.

The inner casing 220 has an opening in the rear surface, and louvers 270 are provided in the opening. A ventilation hole is formed in the wall of building to be hidden by the ventilator 200.

In other words, air sucked in through the motor 240 and the blowing fan 230 is discharged sequentially through the louvers 270 and the ventilation hole.

Additionally, a packing 280 may be provided where the outer casing 210 and the inner casing 220 contact each other, preventing influx of dust or other foreign bodies between the outer casing 210 and the inner casing 220.

The blowing fan 230 is received in the inner space 220*a* of the inner casing 220. The blowing fan 230 is connected with the motor 240, which is described below, through a belt B, with a portion of the rotation shaft 231 of the blowing fan 230, which is formed in the center portion of the rear surface, penetrating the inner space of the housing 290.

The housing 290 has an opening in the top and an empty space inside, and the top of the housing 290 is fixed to the top of the outer casing 210.

A pulley P2 is mounted on a portion of the rotation shaft 231, which is positioned inside the housing 290, and an end of the rotation shaft 231 is fixed to a bearing (not shown) provided inside the housing.

The motor 240 is installed on the top of the outer casing 210, and a pulley P1 is mounted on the motor shaft.

The pulley P1 on the motor shaft and the pulley P2 on the rotation shaft 231 are connected together via a single belt B.

In the instant embodiment, the motor 240 may be a DC or AC motor whose shaft rotates in a forward or backward direction. When fed power, power is delivered to the rotation shaft 231 through the belt B to rotate the blowing fan 230 in place, thus allowing air to be sucked in and exhausted through the louvers 270 and ventilation hole to the outside.

Here, the motor 240 is preferably waterproofed not to contact the washing water which is described below.

The jet tube 250 is a component to jet a washing product to the blowing fan 230 and the inner space 220*a* of the inner casing 220.

The jet tube 250 is shaped in cross section substantially as a bracket as viewed from side, and the jet tube 250 is installed along the inner wall by brackets (not shown) while being received in the inner space 220*a* of the inner casing 220.

Multiple jet holes 250*a* for jetting a washing product are formed at intervals along the lengthwise or circumferential direction of the jet tube 250.

A side of the jet tube 250 passes through the bottom of the inner casing 220, protruding to the outside. No jet hole 250*a* is formed in the protruding portion of the jet tube 250, and a washing water supplying device or air supplying device as described above in connection with the first embodiment is connected to the protruding portion of the jet tube 250.

In other words, the washing water or air supplied to the jet tube 250 as the washing water supplying device or air supplying device operates is jetted through the jet holes 250*a* to the inner space 220*a* of the inner casing 220 and the blowing fan 230, removing foreign bodies.

Additionally, a drain (not shown) may be installed in the bottom of the inner casing 220 to easily collect washing water that is jetted to the blowing fan 230 and the inner space 220*a* of the inner casing 220 and is then dropped.

While the present invention has been shown and described with reference to exemplary embodiments thereof, it will be apparent to those of ordinary skill in the art that various changes in form and detail may be made thereto without departing from the spirit and scope of the present invention as defined by the following claims.

DESCRIPTION OF ELEMENTS

| | |
|---|---|
| 100, 200: ventilator | 110, 210: outer casing |
| 110b, 120b: installation hole | 111: exhaust pipe |
| 120, 220: inner casing | 120c: exhaust hole |
| 121: flow path | 122: auxiliary flow path |
| 130, 230: blowing fan | 140, 240: motor |
| 150: washing unit | 151: supplying unit |
| 151a: washing product supplying space | |
| 152: injection tube | |
| 1521: drain | 160, 180, 280: packing |
| 170, 260: blocking film | 210a: first ventilation hole |
| 211: flange | 200b: second ventilation hole |
| 231: rotation shaft | 250: jet tube |
| 250a: jet hole | 270: louver |
| 290: housing | |

What is claimed is:

1. A ventilator, comprising:

an outer casing having a mounting space in an inside thereof;

an inner casing mounted in the mounting space of the outer casing;

a blowing fan received in an inner space of the inner casing; and a motor rotating the blowing fan, wherein a helical flow path is formed by grooves on each inner wall surface of the inner casing, wherein an auxiliary flow path shaped as a spiral is formed on a ceiling of the inner casing.

2. A ventilator, comprising:

an outer casing having a mounting space in an inside thereof;

an inner casing mounted in the mounting space of the outer casing;

a blowing fan received in an inner space of the inner casing;

a motor rotating the blowing fan, wherein a helical flow path is formed by grooves on each inner wall surface of the inner casing; and a washing unit, the washing unit including:

a supplying unit inserted between or removed from the outer casing and the inner casing and having a washing product supplying space in an inside thereof, the washing product supplying space connected with the inner space of the inner casing; and an injection tube provided in the supplying unit to inject a washing product to the inner space of the inner casing through the washing product supplying space and having a drain in a side thereof.

3. The ventilator of claim 2, wherein a packing and another packing, respectively, are formed on an inner wall surface of the outer casing and an outer wall surface of the inner casing to face each other.

* * * * *